United States Patent [19]

Monks

[11] Patent Number: 4,728,012

[45] Date of Patent: Mar. 1, 1988

[54] OUTLET VALVES FOR MELT CONTAINING VESSELS

[75] Inventor: James Monks, Middlesbrough, England

[73] Assignee: British Steel Corporation, London, England

[21] Appl. No.: 841,152

[22] Filed: Mar. 19, 1986

[30] Foreign Application Priority Data

Mar. 26, 1985 [GB] United Kingdom ..... 8507880
Oct. 2, 1985 [GB] United Kingdom ..... 8524328

[51] Int. Cl.[4] ..... B22D 41/08

[52] U.S. Cl. ..... 222/598; 222/602; 164/437; 266/236; 266/271

[58] Field of Search ..... 222/598, 602, 603, 597, 222/591, 599; 266/266, 272, 236, 271; 164/437

[56] References Cited

U.S. PATENT DOCUMENTS

| | | | |
|---|---|---|---|
| 3,192,582 | 7/1965 | Cope et al. | 222/597 |
| 3,651,998 | 3/1972 | Kocher | 222/598 |
| 3,760,992 | 9/1973 | Bieri | 222/598 |
| 3,952,922 | 4/1976 | Ditto et al. | 222/598 |
| 4,200,210 | 4/1980 | Riegler et al. | 222/598 |
| 4,586,699 | 5/1986 | Bachmann et al. | 222/600 X |

FOREIGN PATENT DOCUMENTS

| | | |
|---|---|---|
| 0084416 | 7/1983 | European Pat. Off. . |
| 0165292 | 2/1950 | Fed. Rep. of Germany . |
| 1934032 | 10/1970 | Fed. Rep. of Germany . |
| 39-2214 | 3/1964 | Japan . |
| 16521 | of 1906 | United Kingdom . |
| 724158 | 2/1955 | United Kingdom . |
| 1177262 | 1/1970 | United Kingdom . |
| 1777262 | 1/1970 | United Kingdom . |
| 1509877 | 5/1978 | United Kingdom . |
| 2085126 | 4/1982 | United Kingdom . |
| 608610 | 5/1978 | U.S.S.R. . |

*Primary Examiner*—Joseph J. Rolla
*Assistant Examiner*—Nils E. Pedersen
*Attorney, Agent, or Firm*—Bacon & Thomas

[57] ABSTRACT

An outlet valve for a melt-containing vessel includes a lower insert piece mounted in the base of the vessel having an outlet bore passing therethrough from the inside to the outside of the vessel, and an elongate shaft located above and pressed down upon the lower insert piece. The shaft has a lower face mating with an upper face of the lower insert piece and is rotatable relative to the lower insert piece about a generally vertical axis. The bore through the lower insert piece is offset, at least at its upper end, from the axis of rotation. The shaft has a side opening at the lower end thereof capable of aligning with the top of the bore through the lower insert piece in at least one rotational position.

14 Claims, 5 Drawing Figures

OUTLET VALVES FOR MELT CONTAINING VESSELS

BACKGROUND OF THE INVENTION

1. Field of the Invention

This invention relates to outlet valves for vessels containing molten material, e.g. metal or glass. More particularly, although not exclusively, the invention relates to such outlet valves for use in tundishes and ladies arranged for the pouring of metal e.g. steel into continuous casting moulds or ingot moulds.

2. Description of the Prior Art

Hitherto, flow control of molten metal, such as steel, from tundishes into continuous casting molds has commonly been accomplished by one of a limited number of methods. Thus, open-metering nozzles have been used having a pre-determined and critical internal bore diameter as the controlling factor for flow rates. Such nozzles have disadvantages in that firstly they cannot cope with aluminum steels, for example, which have a significant tendency to deposit non-metallic occulusions in flow locations typified by such nozzles, secondly any wear in the critical bore of the nozzle leads to an increasing speed of flow which can soon become too fast for continuous casting conditions, thirdly there is a tendency for the nozzle to freeze at start-up, or to suffer clogging when casting low oxygen steel, or when the steel temperature generally approaches liquidus. Fourthly they tend to be difficult to operate with submerged pouring tubes attached below the metering nozzle.

Alternatively, steel flow has been controlled by the use of stopper rods introduced from above and intended to block the outlet nozzles. Disadvantages of such stopper rods are firstly that they require precise setting and are difficult to adjust to ensure precise control at the start of the cast, and secondly "Skull" formation on the stopper tip or nozzle seating, especially at the start can prevent shut-off, frequently leading to loss of control and overflow in the casting mold, particularly in billet-bloom machines having a relatively small mold capacity. Thirdly, reliability over long sequences is poor.

Another alternative for controlling steel flow has been by means of sliding gates. Although these have been found to be much more reliable than stopper rods, in shutting off, they may not re-open once closed. Indeed, even throttling a steel flow in tundish vessels is sufficient to encourage freezing and blockage debris is in the bores of the gate system. They suffer from the disadvantages that they are expensive, they are heavy, cumbersome and complicated, they require precise setting and careful maintenance by engineering-type personnel, and they are expensive in operating costs.

It has also been proposed to provide an outle valve in the base of a metal containing vessel comprising an annular valve member spring urged from below the vessel into an annular through formed in the inner lining of the base, the edge of the valve member being rotatable from below to move the notch into and out of registry with a vessel outlet opening from the trough through the base.

This latter arrangement suffers from a number of disadvantages. Thus, the linkage through the base for the spring urging mechanism inevitably involves leakage problems with risk of air ingress and/or steel freezing. No vertical misalignment of the valve member can be tolerated and the disposition of the valve mechanism below the vessel means that any break out could be very damaging. Still further, the notch and outlet will seriously wear during teeming, thus resulting in inadequate closure and subsequent freezing.

It is an object of the present invention to provide an outlet valve for metal containing vessels which overcomes or at least substantially reduces the above mentioned problems and disadvantages.

SUMMARY OF THE INVENTION

According to the invention there is provided an outlet valve for a melt-containing vessel comprising a lower insert piece mounted in the base of the vessel having an outlet bore passing therethrough from the inside to the outside of the vessel, an elongate shaft located above and pressed down upon the lower insert piece, the shaft having a lower face mating with an upper face of the lower insert piece, the shaft being rotatable relative to the lower insert piece about a generally vertical axis, the bore through the lower insert piece being offset, at least at its upper end, from the axis of rotation and the shaft having a side opening at the lower end thereof capable of aligning with the top of the bore through the lower insert piece in at least one rotational position.

In a preferred embodiment the lower insert piece is fixed, and the shaft is mounted so as to be rotatable upon the lower insert piece about a generally vertical axis.

Preferably the bore through the insert piece opens into its upper face at a position inset from the side edges of the overlying lower face of the shaft.

The shaft may be considered as including two portions, namely: a lower valve portion having the side opening capable of aligning with the top of the bore through the lower insert piece in at least one rotational position thereof, and an upper portion extending upwardly from the valve portion and pressed down upon it, the upper shaft portion being actuable for rotation so as, in turn, to rotate the valve portion.

The upper portion and the valve portion may be formed integrally as a single element or may be separate members secured together.

The shaft and lower insert piece are preferably formed of refractory material and may be composite refractory bodies, with different parts of the bodies having different compositions to meet the requirements of the parts. Thus, for example, the upper portion of the shaft may be formed of an inexpensive refractory material whilst the lower working face of the valve portion may be constituted by an enhanced refractory to resist corrosion around the bore, and may be different for different metals and grades of metals. Again, the mating faces of the valve portion and the lower insert piece may be of a specific hardness appropriate to their relative rotation whilst in pressed mutual contact. Thus, if soft materials are used the relative rotation of the surfaces will act to self grind the faces thereby improving the seal between them.

The mating faces may be of any desired and appropriate geometry to ensure that the shaft is retained on the lower insert piece. Thus, the lower working face of the valve portion may be concave and the upper face of the insert a mating convex shape, or vice versa. The faces may be part or wholly hemispherical or conical, for example, and a flat or dished area may be provided on the upper face of the insert to aid self grinding.

The side opening in the valve portion may be in the form of a cut-away portion from one side, or a port passing therethrough, or may be of any other suitable geometry.

More than one such opening or port, which may be of different geometries, may be provided in the valve portion. The plurality of openings may be used at different times in the pouring cycle.

A gas such as argon may be supplied to the mating faces of the valve portion of the shaft and the lower insert piece. The gas enters the bore of the lower insert piece and the resulting turbulence discourages non-metallic inclusion build-up. The gas may be provided via a conduit passing through the shaft to the valve portion and/or may be provided to the insert piece. The gas may pass to the mating faces via one or more galleries or porous plugs within the shaft and/or the insert piece. Where the gas is provided to the valve portion of the shaft galleries may be cut or drilled in the roof or in the side of the or each port or cut-away.

The invention includes within its scope a metal containing vessel incorporating a valve as herein described, and a method of controlling flow from a melt-containing vessel using a valve as herein described.

BRIEF DESCRIPTION OF THE DRAWINGS

In order that the invention may be more readily understood, a number of embodiments thereof will now be described by way of example with reference to the drawings in which.

DETAILED DESCRIPTION OF PREFERRED EMBODIMENT

Figure 1:
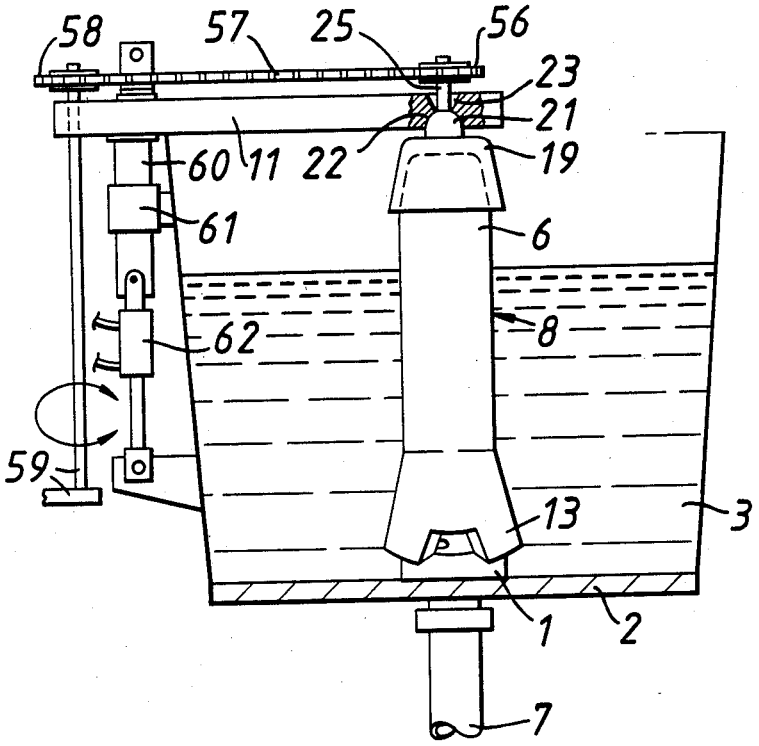
FIG. 1 is a schematic side elevation illustrating a valve in accordance with the invention within a tundish, embodying simple mechanical actuating gear.
Figure 2:
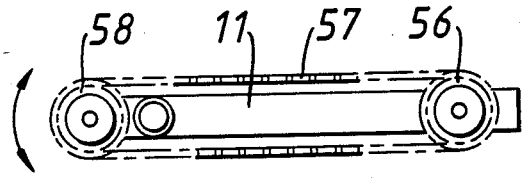
FIG. 2 is a plan view of part of the arrangement of FIG. 1.

Referring now to FIGS. 1 to 4 of the drawings it will be seen that the valve comprises a refractory lower insert member (or "dome") 1 mounted in a seating block in the base 2 of a tundish 3 having a bore 4 (which may be of rectangular, oval or circular section) therethrough offset at its upper end 5 from the vertical center line of the insert 1 and connecting at its bottom end to a submerged pouring tube 7.

Disposed upon and pressed down on the insert 1 is a refractory elongate shaft 8 including an upper portion 6 and a lower valve portion 13. The lower surface 9 of the valve portion 13 of the shaft 8 and the upper surface 10 of the insert are hemispherical in configuration so as to provide a close mating pair of surfaces when the shaft 8 is pressed down. In practice, for one application, the upper face of the insert may have a radius of curvature of approximately 150 mm and a diameter across its horizontal width of approximately 185 mm. The shaft may be approximately 800 mm high.

The shaft 8 is pressed down upon the insert 1 by means of a cantilever cross-arm 11, which is mounted on a slide 60 which passes through a fixed bearing 61 and connects to an air or hydraulic piston and cylinder set 62 for the provision of a downward force on the cross-arm 11 and for rasing the cross-arm during setting-up.

The valve portion 13 of the shaft 8 is provided with a port 14 (which may be of rectangular section) such that the port 14 can be aligned with and open into the upper end 5 of the bore 4 in the insert allowing metal to flow therethrough and, alternatively, can be oriented so that no such connection is made and the valve is shut. The valve portion 13 is also provided with a cut out or slot 55 also capable of alignment with the upper end of the bore 4 for the flow of metal therethrough, the cut out 55 being disposed diametrically opposite the port 14. The shaft 8 is capable of rotational movement through 360° to affect such alignment.

It is to be noted that there is a steel cap 19 fitting upon the upper end 6 of the shaft 8. The cap is provided with a bearing pin 21 to receive the downwardly pressing cantilever cross-arm 11 whilst still permitting rotation of the shaft. The upper end 6 of the shaft 8 is of tapered square section, as is the attached cap 19. The steel cap 19 is mounted on this upper end and the pin 21 is located within a lower recess 22 in the cross-arm 11 connecting with an upper recess 23 for receiving high temperature lubricant to reduce wear and to assist rotation of the shaft in operation.

An upward extension 25 of the pin 21 extends through the arm 11 and is secured to a sprocket 56 connected by chain 57 to a drive 58. A handle 59 is provided to rotate drive sprocket 58. With this arrangement, a full 360° rotation of the shaft is possible.

Figure 3:
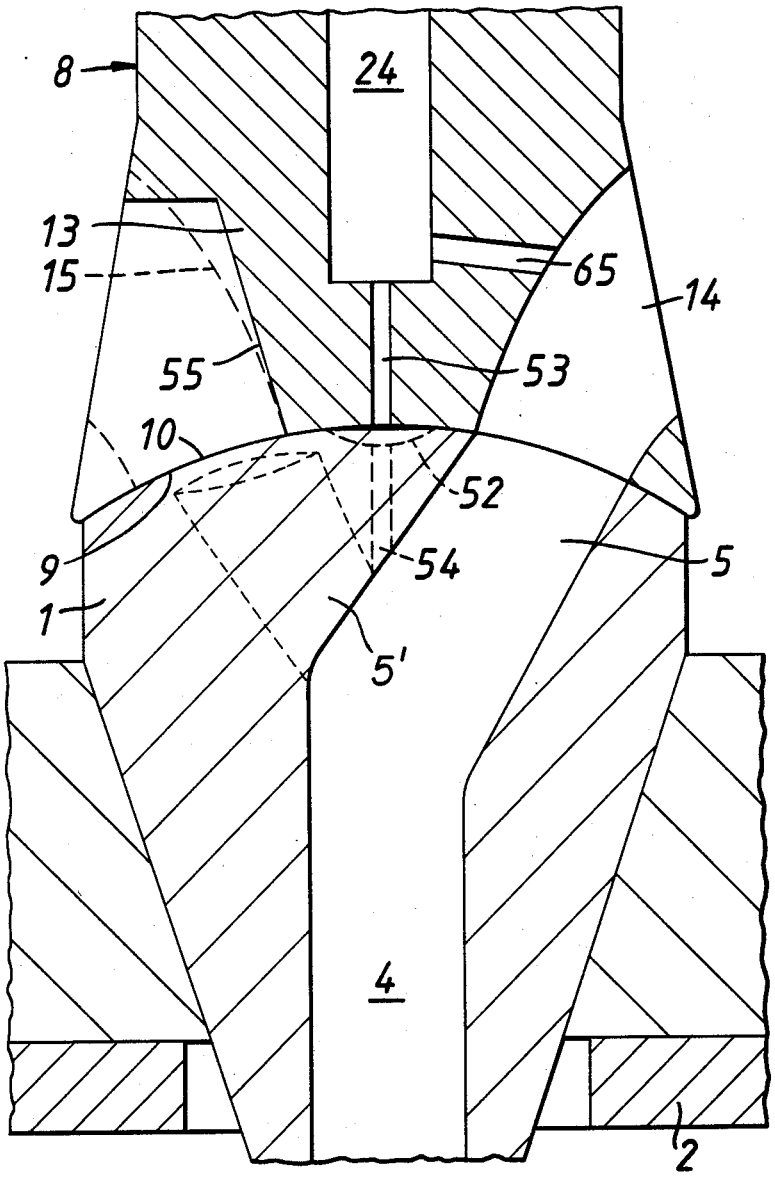
FIG. 3 is an enlarged axial section of a portion of the arrangement of FIG. 1.
Figure 4:
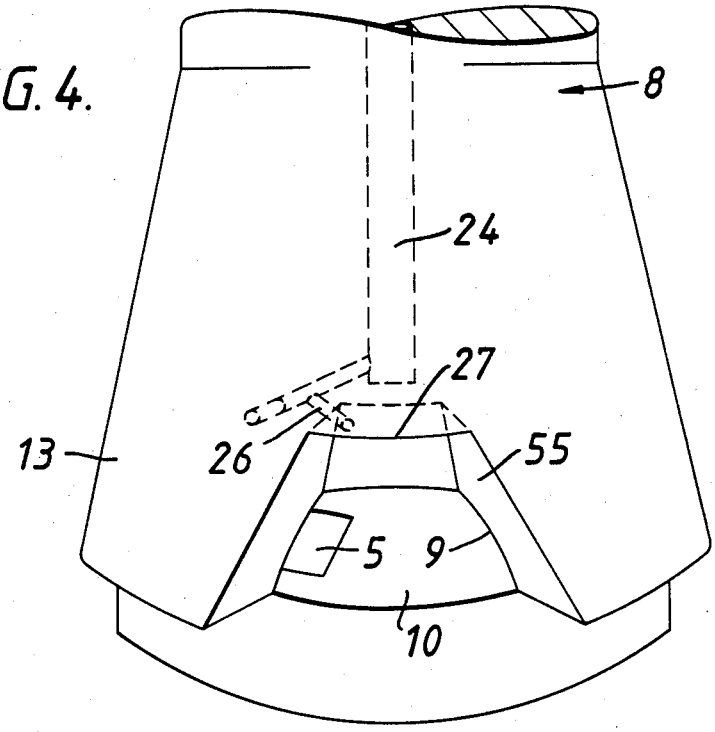
FIG. 4 is an enlarged sketch of an alternative view of the arrangement of FIG. 3.

Injection of an inert gas, such as argon, during pouring of the steel reduces the deposition of non-metallic occlusions in refractory bores and prolongs pour times and for this reason an argon conduit 24 is provided to convey the gas down the shaft from an argon supply pipe (not shown). One arrangement for the injection of the argon at the valve portion 13 of the shaft 8 is indicated in FIGS. 3 and 4 where it will be seen that a gallery 53 from the argon conduit 24 opens on to the mating surfaces 9 and 10 of the valve portion 13 and the insert 8. The upper surface 10 of the insert piece 1 may be provided with a dished portion 52 adjacent the exit of gallery 53 to receive the argon and aid its distribution. Additionally, a gallery 54 may extend downwardly through the insert piece 1 into the upper end 5 of the bore 4 to provide an inlet axially of the shaft and insert for the addition of reagents in wire form or powder/gaseous injection during teeming. The advantage of having this bore exit is that ferrostatic pressures are lower here and thus one does not need very high gas pressures to inhibit steel ingress. In addition, or alternatively, a transverse gallery (or porous plug) 65 may extend from the argon conduit 24 to the exposed upper portion of the port 14. A porous plug is preferred because at this outlet point, the surrounding pressure of metal would require an undesirably high argon flow to prevent steel ingress and blockage if an open gallery were used. Similarly (see FIG. 4) a port or porous plug 26 from the argon conduit 24 may be provided in the upper surface 27 of the cut-away 55 for the gas to be induced into the upper end 5 of the bore in the insert piece to discourage non-metallic build-up by causing turbulence.

The depression or dish 52 in the top of the working face of the insert 1 ensures that this central crown area does not actually bear any load. This greatly improves the integrity of the remaining zones of the bearing surfaces especially around the periphery. The mating faces are initially ground in by rotating the shaft several full revolutions in each direction. The resulting excellence of fit between the faces would be somewhat inhibited without the dished depression in the center since the rotational angular velocity of the central hemispherical faces, being much less than that at the edges, would cause the crown to become proud. The rotor (shaft) would tend then to pivot on the center with imperfect mating at the edges. This depression may alternatively be a shallow cone or a 'flat' with lesser effect.

An additional benefit derived from introducing inert gas in the manner discussed is that the partial vacuum normally produced when throttling the flow of steel from a tundish into a submerged pouring tube is significantly reduced, thereby reducing the tendency to draw in air through the joint between the lower end of the insert and the tube. A distinct advantage of the argon system in this valve compared with that used on stopper rods is that the gas is introduced in the top of the insert bore 5 to maximize its effect. Injected into a stopper nose, the gas has no influence upon the seat area, and non-metallic build-up easily occurs, to the detriment of control capability.

Figure 5:
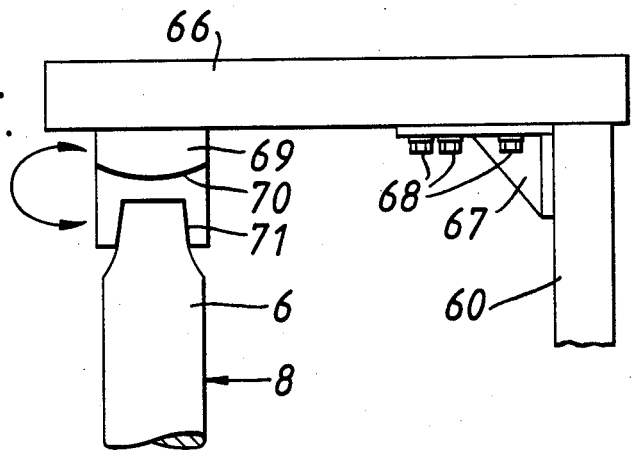
FIG. 5 is a sectional elevation of part of an alternative arrangement to that of FIG. 1.

An alternative arrangement for rotating the elongate shaft is shown in FIG. 5. In this case, the cantilever cross-arm and the associated chain and sprocket rotating mechanism are carried within a protective casing 66. This is carried by the slide 60 by means of a support table 67 to which it is secured by nuts and bolts 68 engaged in slots in bracket 67 to permit longitudinal and transverse adjustment of the cross-arm for correct alignment of the shaft with the lower insert piece. The shaft 8 is engaged and subjected to downward pressure by a drive head 69 incorporating a universal coupling 70 (to facilitate any vertical misaligment with the valve assembly) through which rotational drive is transmitted. The lower portion of the head 69 is provided with a square section recess 71 engagable with the square section upper portion 6 of the shaft 8.

The shaft and the insert piece may be made of any suitable refractory material, such as soft graphite material, which enhances the "self-bedding" effect between surfaces 9 and 10 of the shaft and insert respectively. Alternatively, these surfaces may be provided with a veneer of such enhanced refractory material. Zirconia inserts around the port and cut-away of the shaft, and around the bore in the insert piece, may be provided to preserve integrity of these faces from corrosive wear.

It is to be observed that the valve can, in some instances, be used simply as an on/off valve. Thus with continuous casting machines for producing blooms, where the steels used have no aluminium content, a metering nozzle can be used in conjunction with a valve in accordance with the invention, so that the valve is only required to act as an on/off valve. On the other hand, in connection with continous casting machines for producing aluminium-containing steel, large diameter bores are required to cope with the problem of depositions of aluminous occlusions, and the valve itself can be used equally well as a throttle device with a partial opening. When used in this manner with large bore nozzles, heavily throttling the liquid metal flow, (even into very small molds) no extra safety device is necessary as with the conventional stopper device. Depositions during such throttling operation around the opening into the bore from the cut-away are reduced by the use of argon injection and, in addition, the degree of throttling can be manually controlled or can be automatically controlled, for example, using the signal from a radiation source and a scintillation counter system mounted on the continuous casting mould monitoring the level of metal within the mould.

By using hemispherical mating surfaces between the lower insert and the shaft, a significant degree of axial misalignment of the shaft is readily accommodated without detracting in any way whatsoever from the performance of the valve, since the surfaces will still correctly mate, even with such misalignment.

It is to be noted that, although in the embodiment illustrated only one bore is shown in the lower insert piece a second bore can be provided opening into the lower part of the bore 4 in case the first bore becomes blocked or severely congested by occlusion deposition.

The valve of the invention has a considerable number of advantages. Thus, there is no requirement for critical alignment of the shaft upon the lower insert piece since the design using hemispherical mating surfaces caters for considerable degrees of axial misalignment, making for ease in setting up. Again, compared to conventional stopper rods, there is no proneness to breakage during set-up which can otherwise result from "bumping" of the stopper rod in a misaligned condition. In addition, a positive, certain, shut-off is ensured even after protracted cast times, and in the critical early stages of casting. There is no column of steel left in a bore through the tundish container liable to freeze after shut-off, as in conventional sliding gate systems when, with shut-off, steel in the 'upstream' bore through the wall of the tundish freezes readily. Thus the column of steel below the mating surfaces 9, 10 will drain off and, in re-opening, the bore through the insert is exposed directly to the steel reservoir in the tundish. Yet again, the mating hemispherical surfaces of the insert and the base of the shaft, since they are retained in close proximity, do not suffer the rate of erosion of stopper tips/seats and can, therefore, function satisfactorily for long periods.

In a preferred form of operation, the port 14 in the valve portion 13 is aligned directly and wholly into the matching opening of the upper end 5 of the bore in the insert 1 without exposing (and therefore serving to protect) the upper face 10 of the insert 1. This disposition is then used during a pre-heat mode, so as to protect the mating surface of the dome. After pre-heat, the shaft is rotated to close the bore in the insert and molten metal is supplied to the tundish. Steel can tend to stagnate and solidify in the enclosed port 14 in relatively cold conditions pertaining at the start of casting, but not so in the more open cut-away slot 55, so that to open up at the start of pouring, the shaft is rotated to align the cut-away 55 to the upper end 5 of the bore 4. During long casting periods however, erosion of the upper face 10 of the insert 1 can occur using the cut-away mode so that after initiating pouring when the valve portion 13 (and the metal contents of the port 14) have heated up, the shaft is rotated through 180° to align the port 14 with the upper end 5 of the bore 4. Pouring is then continued with consequent erosion protection. This operating procedure is particularly desirable when heavily throttling large bore sizes on billet/bloom casting machines, and with erosive dead-mild steels.

Two ports may be used in the shaft instead of one port and the cut- away e.g. instead of the latter a further port 15, as illustrated in FIG. 3, may be provided, and one of these ports may be filled with a refractory filler powder for starting. On pre-heating the mechanism the 'clear' port can be aligned with the bore in the insert.

Subsequently, when teeming from the tundish, the filler powder prevents the second port from steel ingress until the shaft is rotated to align this port with the bore in the insert. The powder then falls through the bore and steel follows for a clean start. This technique is particularly important where the valve is used in conjunction with a non-removable sub-pour tube where oxygen cannot be employed at the start of casting.

As another alternative it would be possible to operate with a single port in the shaft and a bifurcated bore in the insert. Referring to FIG. 3, bifurcated bore 5' connects bore 4 to another orifice in the upper face of the insert. If one of the bifurcated bores should block during teeming, one can readily switch to the other unused bore. The single port in the shaft would be less prone to blockage than the insert bores since it is in the hot steel reservoir. It will be appreciated that in the single port variation of the valve oxygen may be fed down the shaft into the gallery 65 to aid starting.

It is to be noted that there may be a smaller port in the shaft than in the insert. Throttling can be effected on either side of the larger bore in the insert. Rectangular bores and ports are favored because an equivalent area of bores in circular form will extend further towards the outer periphery of the lower insert/shaft thus reducing the "sealing" area.

Although rectangular section openings for the ports 14 and 15 are described, other configurations are possible, such as circular, square, trapezoidal, or oval.

Amongst the advantages of the valve of the invention are the following:

a. It is self-draining and it can be repeatedly opened and closed even over long periods with little danger of failure to re-start. It is therefore ideal for use with a tube changing system in continuous casting. The positive action of the rotary valve minimizes the danger of leakage, and gives accurate control over a wide range of steel flow rates.

b. The rotary valve has a lower initial capital cost, both for the ceramic components and for the actuator system, than for the necessary components for a slide-gate valve system.

c. No expensive diamond grinding on mating surfaces is required, as with slide-gate valves.

d. The design is robust—the main components operate in compression, the strongest mode for the materials, and breakage is avoided.

e. Slow and controlled filling of a continuous casting mould at start-up is precise and safe. This is important because fast start-ups can lead to casting break-outs. Contrariwise, stopper systems frequently malfunction at this critical time with serious consequences.

f. A large degree of vertical misalignment of the stem can be tolerated.

g. There is no actuating mechanism appended beneath the holding vessel to interfere with operator vision. Furthermore, there is no risk of damage in this vulnerable location as with other devices operated from below.

h. Since the principal teeming outlet is inboard of the edge of the working faces, a perfect seal is retained by the self-bedding facility of rotating the shaft; this can be maintained despite any incidence of local wear around the teeming bore.

j. The valve requires no back-up safety 'guillotine' device, as do conventional stoppers, to cope with malfunctions in casting areas to prevent damage.

k. The valve can cope more readily with alumina build-up and clogging in the bores than other flow-control systems.

l. In the event of clogging of the insert bore severe oxygen lancing of the valve can be tolerated to enable casting to continue, without damage to the mating faces. Stopper tips can be seriously damaged by oxygen.

m. Setting up of the valve system is easily accomplished by relatively non-skilled operating personnel and it is primarily simple in use.

n. On bloom/billet casters one operator can capably run several strands, unlike a stoppered arrangement; in emergency, shut-off is achieved rapidly and effectively.

p. The argon injection arrangement can be such that it is not subject to the suction existing in the partially throttled lower bore hence air ingress in suspect pipe joints is not a problem as with stoppers.

I claim

1. An oultet valve for a melt-containing vessel comprising a lower insert piece of refractory material rigidly mounted in the base of the vessel and having an outlet bore passing therethrough from the inside to the outside of the vessel, the bore opening into an orifice in an upper face of said insert piece, an elongate refractory shaft located over and pressed down from above upon the lower insert piece, the shaft having on its underside a lower face mating with the upper face of the lower insert piece, the shaft being rotatable about its elongate axis upon the lower insert piece, the bore through the lower insert piece being offset, at least at its upper end, from the axis of rotation, the orifice of the bore in the upper face of said insert piece being inset from the side edges of the overlaying lower face of the shaft and the shaft having a side opening at the lower end thereof capable of aligning with the orifice of the bore through the lower insert piece in at least one rotational position.

2. A valve as claimed in claim 1 wherein the shaft and the insert piece are composite refractory bodies, with the lower face of the shaft and the upper face of the lower insert piece being formed of enhanced refractory to resist erosion around the bores and aid sealing between the two faces.

3. A valve as claimed in claim 2 wherein the lower face of the shaft and the upper face of the lower insert piece are formed of a soft graphite material.

4. A valve as claimed in claim 1 wherein the mating faces of the shaft and the insert piece are at least partially hemispherical.

5. A valve as claimed in claim 1 wherein the shaft includes a plurality of said side openings spaced therearound.

6. A valve as claimed in claim 1 claims wherein at least one shaft side opening comprises a port extending inwardly through the shaft to the lower face thereof.

7. A valve as claimed in claim 6 wherein the shaft has an additional side opening in the form of a cut-away portion extending down to the lower face thereof and spaced from the said port in the shaft, the cut-away portion being capable of opening into the top of the bore through the lower insert piece.

8. A valve as claimed in claim 7 wherein the cut-away portion has a larger cross-sectional area than the port in the shaft.

9. A valve as claimed in claim 1 wherein there is a bifurcated bore in the insert piece, having two separate openings into the upper surface thereof.

10. A valve as claimed in claim 1 wherein at least one of the said bores and/or ports is of generally rectangular configuration.

11. A valve as claimed in claim 1 including an injection conduit extending through the shaft into at least one of said ports or openings.

12. A valve as claimed in claim 11, wherein the injection conduit extends axially through the shaft and aligns with a like injection conduit in said insert which opens into the bore in the insert.

13. A valve as claimed in claim 1 wherein the shaft is pressed down upon the lower insert piece by means of a downwardly urged cantilever arm extending over the vessel and engaging the top of the shaft.

14. A valve as claimed in claim 13 wherein rotation of the shaft is from above by means of linkages associated with the cantilever arm.

* * * * *